United States Patent [19]

Chabis

[11] Patent Number: 4,773,227

[45] Date of Patent: Sep. 27, 1988

[54] COMBUSTION CHAMBER WITH IMPROVED LINER CONSTRUCTION

[75] Inventor: Ronald P. Chabis, Jupiter, Fla.

[73] Assignee: United Technologies Corporation, Hartford, Conn.

[21] Appl. No.: 366,279

[22] Filed: Apr. 7, 1982

[51] Int. Cl.[4] ..... F23R 3/60

[52] U.S. Cl. ..... 60/757; 60/752

[58] Field of Search ..... 60/752, 755, 757, 760, 60/753, 754, 759

[56] References Cited

U.S. PATENT DOCUMENTS

| | | | |
|---|---|---|---|
| 2,617,255 | 11/1952 | Niehus | 60/757 |
| 4,302,941 | 12/1981 | DuBell | 60/757 |
| 4,471,623 | 9/1984 | Griffin | 60/752 |
| 4,512,159 | 4/1985 | Memmen | 60/752 |

*Primary Examiner*—Ted L. Parr

*Attorney, Agent, or Firm*—Stephen E. Revis

[57] ABSTRACT

A combustion chamber, such as for a gas turbine engine, includes a protective liner comprised of a plurality of arcuate panels attached to the combustion chamber wall by means of hook-like hangers or lugs integral with and extending radially from the panels through slots in the combustion chamber wall. The lugs hang from retaining strips disposed across a portion of the slots through which the hangers pass. The strips prevent the lugs from being withdrawn from the slots, thereby, positioning the panels radially. Axial and circumferential positioning of the panels is accomplished by means of a close fit between the hangers, slots, and retaining strips. The free floating or nonrigid manner in which the liner panels are attached to the combustion chamber prevents undue stresses from developing in the combustion chamber wall due to the differential thermal growth rates of the combustion chamber wall and the liner panels during engine operation.

7 Claims, 3 Drawing Sheets

COMBUSTION CHAMBER WITH IMPROVED LINER CONSTRUCTION

The Government has rights in this invention pursuant to Contract No. F33657-78-C-0256 awarded by the Department of the Air Force.

DESCRIPTION

Technical Field

This invention relates to combustion chambers and more particularly to apparatus for cooling the walls of combustion chambers.

Background Art

It is well known in the art to form combustion chambers of gas turbine engines with axially adjacent double walled cylindrical sections, wherein cooling air from outside the combustion chamber is brought into the annulus between the walls and travels axially through the annulus exiting at an open end thereof. The hot inside walls of axially adjacent sections partially overlap and are radially spaced apart in louver fashion such that the air exiting from the annulus of the upstream section flows into the combustion chamber over the hot inside surface of the next downstream section, thereby cooling the same. Axially extending fins or ribs within the annular gaps and attached to the hot inside walls improves heat transfer.

Further details of the above-referred to type of combustion chamber construction may be found in commonly owned U.S. Pat. No. 3,706,203. In that patent the inlets for the cooling air to the annular gaps of each section are between the upstream and downstream ends of each section; and the cooling air that enters the annular gap through those inlets thereupon flows in both the upstream and downstream directions into the combustion space.

In the foregoing prior art construction the hot inside wall or liner of the combustion chamber is rigidly attached, such as by welding, or the like, to the outer, cooler wall. Differential growth rates, particularly during transient operating conditions, can induce high stresses at the attachment points and ultimately reduce the life of the combustion chamber. It would be desirable to eliminate the rigid means of attaching the inside liner to the combustion chamber wall and, in particular, to have the means for attachment located outside the combustion chamber where it is cooler. This would reduce the likelihood of stresses during operation and further increase the combustion chamber life expectancy.

In commonly owned U.S. patent application Ser. No. 136,631 "Combustor Liner Construction For Gas Turbine Engine" filed Apr. 2, 1980, the liner for a combustion chamber comprises panels which are loosely hung from the combustion chamber wall by means of nut and bolt assemblies. The shank of a bolt is passed through holes in the liner panel from the combustion space side and through a corresponding hole in the combustion chamber wall, whereupon a nut is threaded onto the end of the bolt. The bolt head fits in a counter sunk hole in the liner panel. While nut and bolt attachment means may accomplish the desired objective of nonrigidly attaching the panels to the combustion chamber wall, a disadvantage is that bolts which break during operating will fall into the combustion chamber and be swept downstream through the turbine, potentially causing serious damage. Furthenmore, the bolt heads are directly exposed to the hot combustion gases, and there may be gas low discontinuities generated in the vicinity of the bolt heads. The present invention retains the desired features of the invention described in the commonly owned patent appication Ser. No. 136,631 and has none of the disadvantages.

Commonly owned U.S. patent application Ser. No. 136,652 "Combustor Liner Construction" filed Apr. 2, 1980 U.S. Pat. No. 4,414,816 shows another means for reducing thermally induced stresses in a combustion chamber. In that patent application the combustion chamber is constructed from a plurality of double walled panels nonrigidly supported from a lattice-like frame. The walls of each double walled panel are rigidly secured to each other by a plurality of radially and axially extending ribs.

DISCLOSURE OF INVENTION

One object of the present invention is a combustion chamber with a thermally compatible liner.

Another object of the present invention is to reduce thermal stresses in a lined combustion chamber.

According to the present invention, a combustion chamber comprises arcuate liner panels, each panel including hangers extending radially through slots in the combustion chamber wall, wherein the liner panels hang from retainers secured to the cool side of the combustion chamber wall and which overlie portions of each slot through which the hangers extend, the liner panels defining an annulus for cooling air flow adjacent the combustion chamber hot wall.

The axial and circumferential fits between the hangers and the edges of the slots and the radial fit between the liner panels and the combustion chamber wall are selected to accurately position the panels while allowing sufficient movement of the liner panels relative to the combustion chamber wall during transients of engine operation to eliminate undue stresses. Cooling air is brought into the annular gap between the combustion chamber wall and the liner panels via holes through the combustion chamber wall. The liner panel wall surface facing the combustion chamber wall preferably includes axially extending ribs to improve the transfer of heat from the cooling air to the liner panel and to direct the air flow in an axial direction. In an exemplary construction, the cooling air exiting from the annular gap of one panel is directed over the hot surface of an axially adjacent downstream liner panel.

In addition to the reduced stresses which result from having the combustion chamber liner panels being nonrigidly attached (i.e., hung) from the combustion chamber wall, a further advantage of the present construction is that the area of attachment between the liner sections and the combustion chamber wall is on the cool side of the combustion chamber wall such that it is constantly exposed to relatively cool air.

The foregoing and other objects, features and advantages of the present invention will become more apparent in the light of the following detailed description of the preferred embodiment thereof as shown in the accompanying drawing.

BEST MODE FOR CARRYING OUT THE INVENTION

Figure 1:
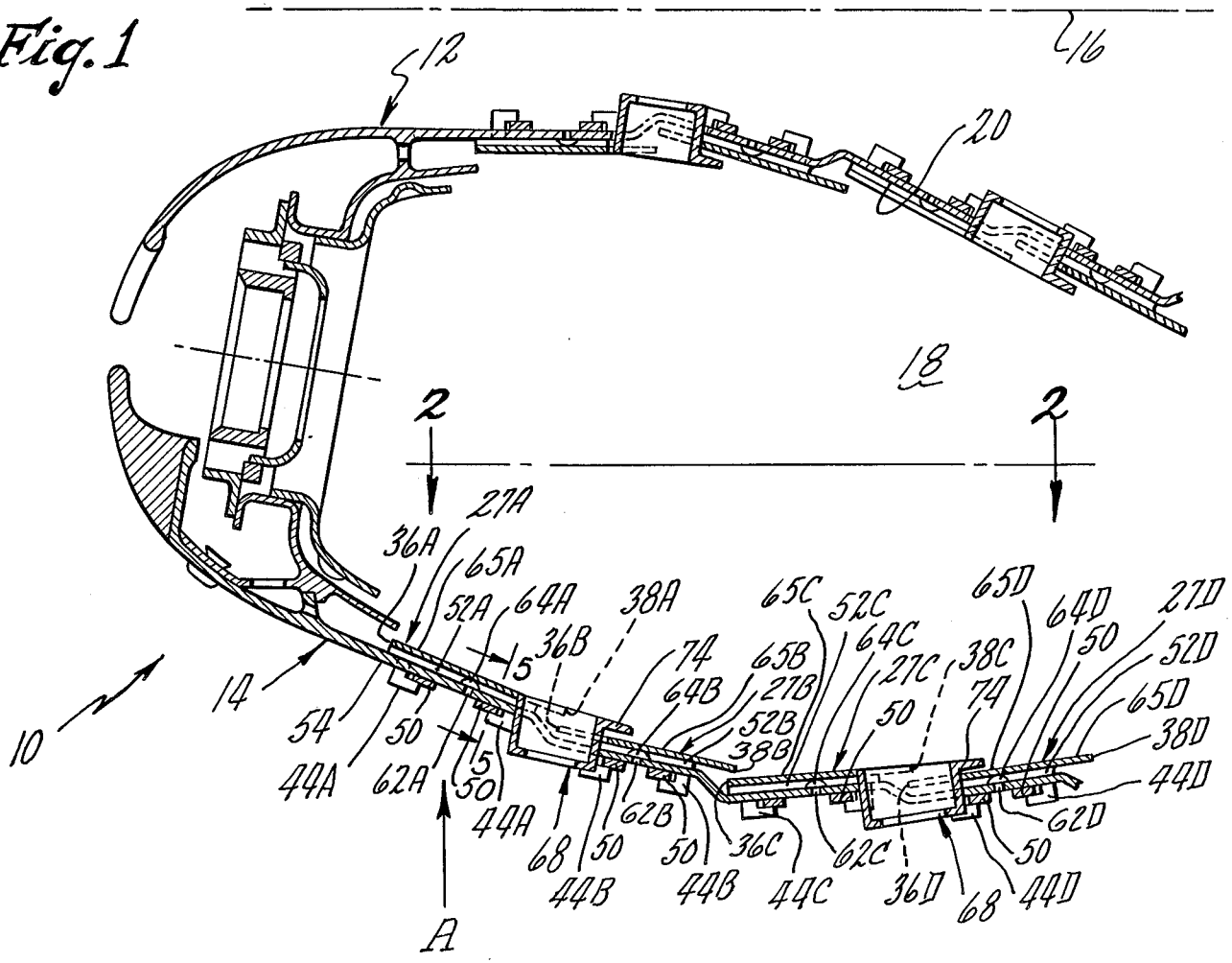
FIG. 1 is a simplified cross sectional view of a portion of an annular combustion chamber incorporating the features of the present invention.

As an exemplary embodiment of the present invention consider the portion of an annular combustion chamber 10 of a gas turbine engine shown in simplified cross section in FIG. 1. The combustion chamber 10 includes an inner combustion chamber wall 12 and an outer combustion chamber wall 14 which are both circular in cross section about an axis 16 of the combustion chamber. The walls 12, 14 define an annular combustion space 18 therebetween. In this embodiment the inside surfaces 20, 22 of the inner and outer combustion chamber walls 12, 14, respectively., which face the combustion space 18, are protected from the hot combustion chamber gases by a system of arcuate liner panels 27 which dull hereinafter be described in detail in connection with the outer wall 14. It will become apparent that a similar system of liners can also be used in a can (as opposed to annular) type of combustion chamber.

Figure 2:
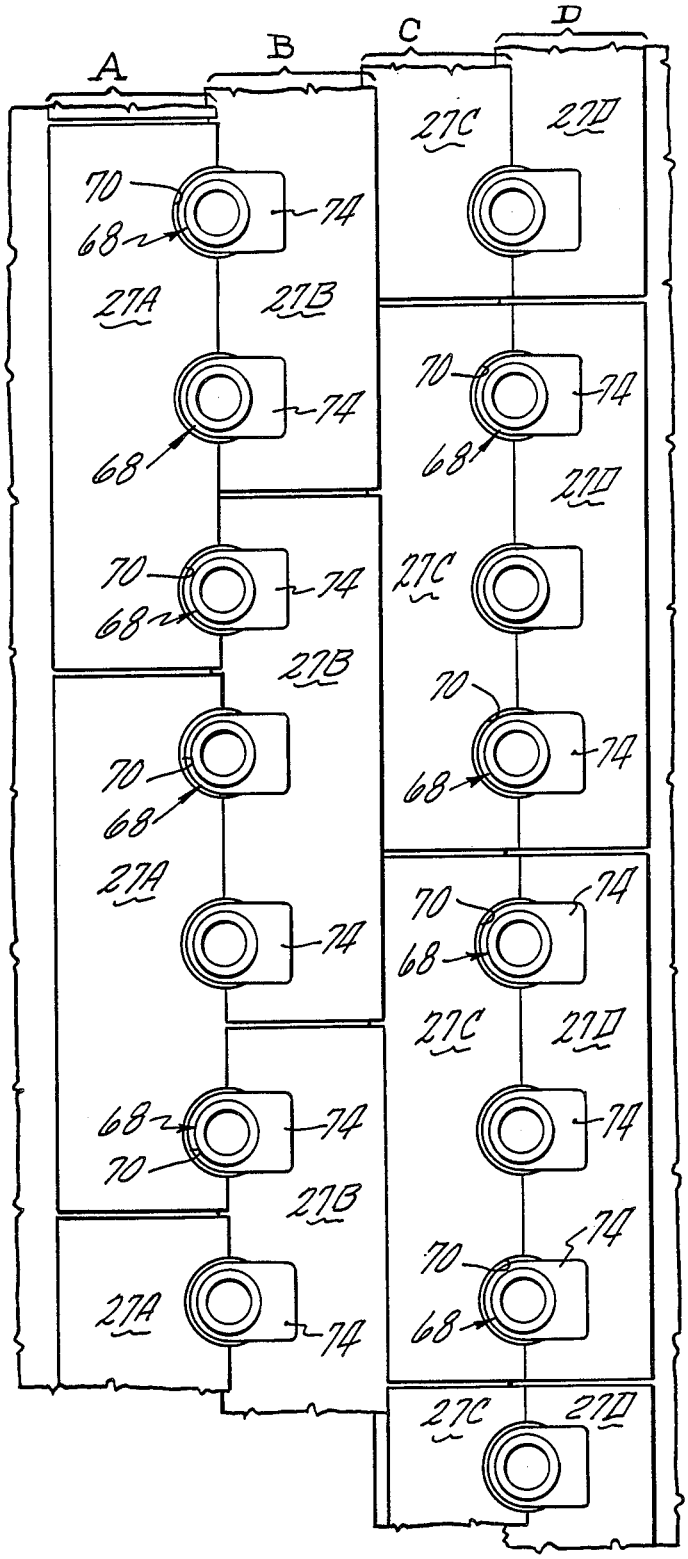
FIG. 2 is a simplified developed view taken in the direction 2—2 of FIG. 1 showing a portion of the inside of the combustion chamber.

Referring to FIGS. 1 and 2, the inside wall surface 22 is covered by four axially offset and slightly overlapping circumferential rows A, B, C and D of liner panels 27A, 27B, 27C and 27D, respectively. In the drawing, corresponding elements of the liner panels 27A, 27B, 27C and 27D are given the same reference numerals, suffixed by the letter of the row in which they are axially disposed. When these reference numerals are used without a letter suffix they are meant to apply to the panels 27 in all of the rows.

Figure 3:
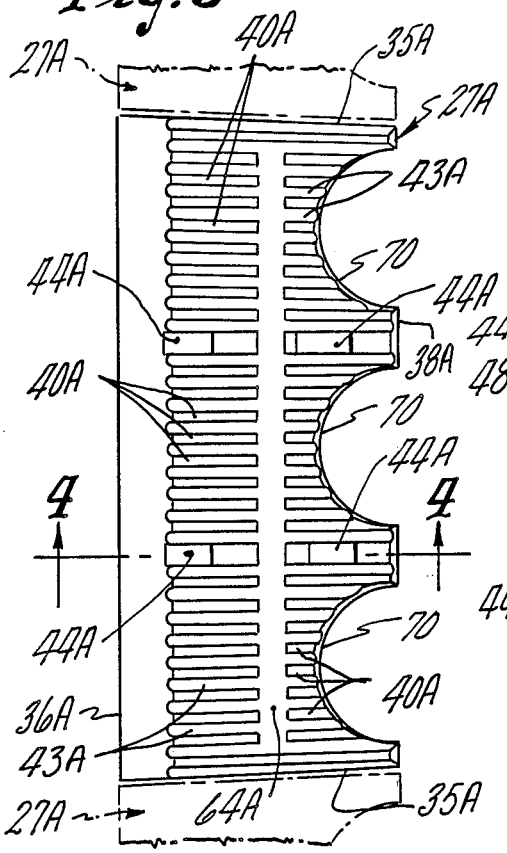
FIG. 3 is a view taken in the direction A with the combustion chamber wall and dilution air tubes removed, showing a liner panel according to the present invention.
Figure 4:
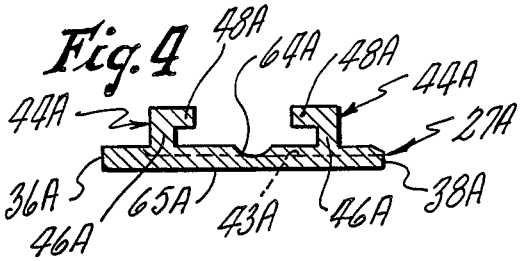
FIG. 4 is a sectional view taken along the line 4—4 of FIG. 3.
Figure 5:
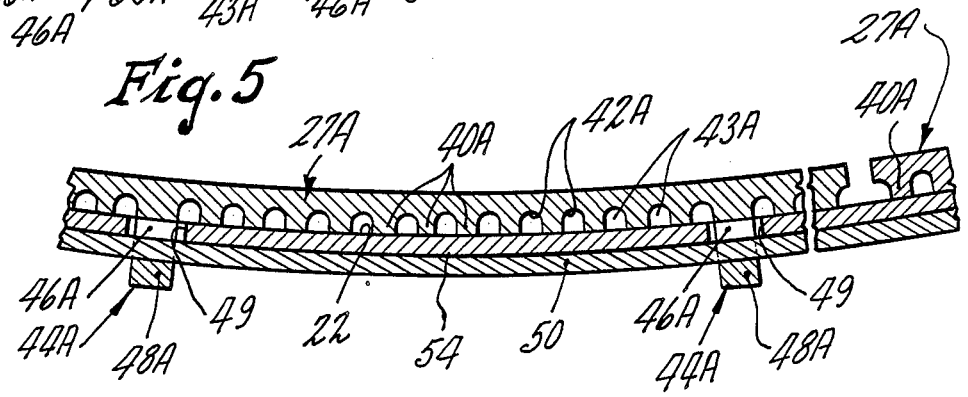
FIG. 5 is a sectional view taken along the line 5—5 in FIG. 1.

A liner panel 27A is shown in FIGS. 3 and 4 and is generally representative of all of the panels 27. Each panel 27A includes axially extending edges 35A, an upstream edge 36A and a downstream edge 38A. As best shown in FIGS. 3 and 5, the panel 27A has axially and radially extending circumferentially spaced apart ribs 4OA integral with a surface 42A thereof which faces the combustion chamber wall 14. The ribs 4OA and the surfaces 42A and 22 define a plurality of axially elongated, circumferentially spaced apart passageways 43A. In this embodiment each panel 27A includes four hangers 44A, two in each of two axially spaced apart rows, with the hangers of each row being axially aligned with the hangers of the other row, although this is not essential to the invention. Each hanger 44A has a leg 46A extending radially outwardly from the wall surface 42A, and a lip 48A extending at right angles from the leg 44A in an axial direction. Although four hangers are preferred for each panel, it will become apparent that a greater number or as few as two may be used.

Aligned with each row of liner panels 27A, 27B, 27C and 27D are two axially spaced apart rows of circumferentially spaced apart attachment slots 49. The slots 49 are positioned and sized to receive the hangers 44 therethrough. When all the panels within a row A, B, C or D are in position with their hangers 44 extending through the slots 49, the edges 35 of circumferentially adjacent panels 27 are closely spaced from each other defining a segmented liner wall of circular cross section radially spaced from the inside surface 22 of the wall 14. The rows of panels thereby define a plurality of axially offset annular gaps 52A, 52B, 52C, 52D. The minimum radial dimension of the gaps 52 are determined by the height of the ribs 40.

Figure 6:
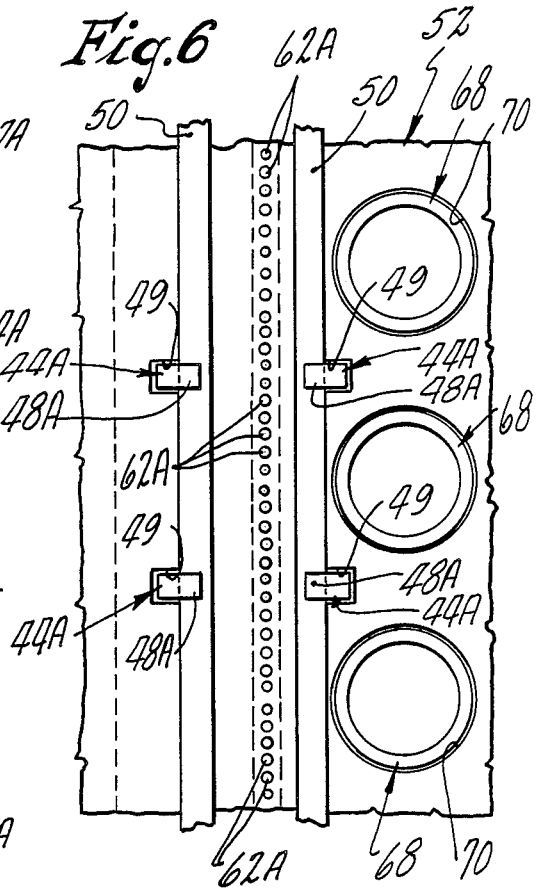
FIG. 6 is a view taken in the direction A showing a portion of the combustion chamber outer wall from outside of the combustion chamber.

Retaining strips 50 are used to secure the liner panels in position radially and axially. In this embodiment a continuous strip 50 (see FIG. 6) surrounds a row of slots 49 and overlaps a portion of each slot 49 in the row. (Each continuous strip 50 could equally as well be comprised of a plurality of discrete strips, one for each slot 49 or for several slots.) The strips 50 are welded to the cool, radially outwardly facing, outside surface 54 of the combustion chamber wall 14. The lips 48 of the hangers 44 overlie a portion of a strip 50 to an extent sufficient to prevent the hangers 44 from being withdrawn from the slots 49. The axial and circumferential fit of the hangers 44 within the slots 49 and the radial fit of the panels 27 with respect to the retaining strips 50 and the combustion chamber wall 14 may readily be selected to retain the panels within fairly close tolerance of their desired axial, circumferential and radial position without undue stresses being imposed on the combustion chamber components during operation due to differential thermal growth rates. Preferably the fits are slightly loose, but slightly tight fits may also be used. Furthenmore, because the hangers 44 are integral with the panels 27, are not directly exposed to hot gases, and impose no flow discontinuities inside the combustion chamber, the life expectancy and integrity of the present construction is improved over prior art designs.

Cooling of the combustion chamber wall 14 and of the liner panels 27 is accomplished by introducing air into the annular gaps 52A, 52B, 52C, 52D via corresponding rows of circumferentially spaced apart cooling air holes 62A, 62B, 62C, 62D (best seen in FIG. 6) through the combustion chamber wall 14. The holes 62 are aligned with circumferentially extending troughs 64 (best seen in FIGS. 3 and 4) which cut across the ribs 44 to help evenly distribute the cooling air amongst the passageways 43. Air enters the troughs 64 through the holes 62 flows into the passageways 43 in both an upstream and downstream direction. As can best be seen in FIG. 1, the downstream edges 38 of each row of panels 27 (except a last or most downstream row) is spaced radially inwardly from the upstream edges 36 of the next row of panels 27. Air exiting from the downstream end of the passageways 43 in one of these rows of panels (e.g., 27A) comingles with air exiting the upstream ends of passageways 43 of the next following row of panels (e.g., 28B). This air mixture is directed downstream and forms a film of cooling air on the hot inside surfaces 65 of the said next following panels thereby cooling the same.

Although not a part of the present invention, in this embodiment dilution and combustion air holes 66 (FIG. 6) are located axially between adjacent rows A, B and adjacent rows B, C of panels 27. To achieve effective cooling of the combustion chamber wall 14 without disturbing the velocity of the cooling air in the passageways 43 which are in the path of these holes 66, a tube member 68 is inserted into each hole 66 through the combustion chamber wall 14 and extends into the combustion space 18 through semicircular cutouts 70 in the edges 36, 38 of the panels. The tube members 68 may be tack welded to the combustion chamber wall 14. To further enhance cooling, a lip 74 is formed on the downstream portion of each tube member 68 so that air egressing from the upstream end of the passageways 43 immediately downstream of a tube member 68 impinges on the downstream facing outer surface of the tube member and then is redirected by the lip 74 over the hot inside surface 65 of an adjacent downstream panel 27.

Although the invention has been shown and described with respect to a preferred embodiment thereof, it should be understood by those skilled in the art that other various changes and omissions in the form and detail thereof may be made therein without departing from the spirit and the scope of the invention.

I claim:

1. A combustion chamber for a gas turbine engine comprising:

wall means defining a combustion space, said wall means including a first wall of circular cross section about an axis, an inside surface facing said combustion space, an outside surface facing away from said combustion space, said first wall also having attachment slots therethrough;

retaining means secured to said outside surface, a portion of said retaining means overlapping a portion of each of said slots;

liner means including a plurality of arcuate liner panels circumferentially disposed about said axis defining a segmented wall of circular cross section having a first surface facing said combustion space and a second surface opposed to and spaced from said first wall forming an axially extending annular gap therebetween, each panel including a plurality of hangers adapted to support said panels in nonrigid rotation to said first wall, each hanger comprising a leg extending radially from said second surface through one of said slots, each leg including a lip extending outwardly therefrom and radially spaced from said second surface, said lip overlying said portion of said retaining means which overlaps said slot, wherein said panels are retained radially and located circumferentially and axially by said hangers in combination with said retaining means and said slots.

2. The combustion chamber according to claim 1 wherein said first wall includes a plurality of cooling air holes therethough in comunication with said annular gap for bringing air from outside said combustion space into said annular gap.

3. The combustion chamber according to claim 2 wherein each of said arcuate panels includes a plurality of axially extending ribs projecting radially from said second surface defining a pluraity of circumferentially spaced apart, axially elongated passageways thin said annular gap.

4. The combustion chamber according to claim 3 wherein said first wall has at least two axially spaced apart rows of circumferentily spaced apart attachment slots therethrough, each of said arcuate panels being circumferentially aligned with at least two of said slots in each of two of said rows of slots, each pan including a hanger extending through each of said slots with which said panel is aligned.

5. The combustion chamber according to claims 2, 3 or 4 wherein said liner means includes a plurality of said segmented walls axially offset from each other, said segmented walls being constructed and arranged such that cooling air from within the said annular gap associated with one of said segmented walls is directed over said first surface of the said segmented wall imediately downstream thereof.

6. The combustion chamber according to claims 1 or 4 wherein said retaining means comprises a continuous strip of metal overlapping portions of all of said slots in one of said rows of slots.

7. The combustion chamber according to claim 1 wherein said wall means includes a second wall of circular cross section concentric with said first wall, said combustion space being the annulus between said first and second walls.

* * * * *

UNITED STATES PATENT AND TRADEMARK OFFICE

CERTIFICATE OF CORRECTION

PATENT NO. : 4,773,227

DATED : September 27, 1988

INVENTOR(S) : Ronald P. Chabis

It is certified that error appears in the above-identified patent and that said Letters Patent is hereby corrected as shown below:

ON THE TITLE PAGE,

[57] line 16: change "differential" to --different--

Column 2, line 5: change "appication" to --application--

Column 3, line 31: change "dull" to --will--

Column 4, line 33: change "Furthenmore" to --Furthermore--

Column 6, line 8: change "comunication" to --communication--

Column 6, line 14: change "pluraity" to --plurality--

Column 6, line 15: change "thin" to --within--

Column 6, line 22: change "pan" to --panel--

Column 6, line 31: change "imediately" to --immediately--

Signed and Sealed this

Fourteenth Day of February, 1989

*Attest:*

DONALD J. QUIGG

*Attesting Officer*

*Commissioner of Patents and Trademarks*